United States Patent [19]

Kajikawa et al.

[11] Patent Number: 4,494,589

[45] Date of Patent: Jan. 22, 1985

[54] VENEER LATHE

[75] Inventors: Yoshimitsu Kajikawa; Keinosuke Souma; Kohei Ogaki; Tadashi Uzuka; Yoshihiko Minato, all of Hakodate, Japan

[73] Assignee: Uroko Seisakusho Co., Ltd., Hakodate, Japan

[21] Appl. No.: 408,172

[22] Filed: Aug. 16, 1982

[30] Foreign Application Priority Data

Aug. 17, 1981 [JP] Japan ..... 56-129867

[51] Int. Cl.[3] ..... B27L 5/02

[52] U.S. Cl. ..... 144/213; 144/365

[58] Field of Search ..... 144/209 R, 211, 213, 144/365

[56] References Cited

U.S. PATENT DOCUMENTS

| | | | |
|---|---|---|---|
| 1,641,452 | 9/1927 | Osgood | 144/213 |
| 3,207,194 | 9/1965 | Hedberg et al. | 144/213 |
| 4,221,247 | 9/1980 | Katsuji | 144/213 |
| 4,262,716 | 4/1981 | Hasegawa | 144/213 |
| 4,263,948 | 4/1981 | Hasegawa | 144/213 |
| 4,269,243 | 5/1981 | Hasegawa | 144/209 R |

*Primary Examiner*—W. D. Bray

*Attorney, Agent, or Firm*—Finnegan, Henderson, Farabow, Garrett & Dunner

[57] ABSTRACT

A veneer lathe comprising a knife for peeling a veneer from a log, a plurality of pressure nose bars retained as regularly spaced on a pressure bar frame and disposed parallelly to the knife, a plurality of circular discs of a smooth circumferential face interposed between the adjacent pairs of the pressure nose bars and retained in position by the pressure bar frame through the medium of a drive shaft, means for driving the drive shaft, means for inching the pressure bar frame toward the log in proportion as the cutting of the log proceeds, and pressure means for advancing the circular discs toward the log independently of the action of the inching means thereby keeping the log under a substantially constant pressure.

5 Claims, 8 Drawing Figures

VENEER LATHE

BACKGROUND OF THE INVENTION

This invention relates to a veneer lathe for peeling a veneer from a log by holding the log in position and rotating it about its horizontal axis by means of spindles applied fast one each to the opposite end faces of the log and pressing a knife of a length enough at least to extend over the entire length of the log against the periphery of the log in rotation. More particularly, this invention relates to a veneer lathe capable of increasing the yield of a high-quality veneer usable as face and back veneers in plywood which determines the commercial value of the finished plywood and most suitable also for the production of a veneer from low-grade logs of embrittled or cracked texture.

Recently in the plywood manufacturing plants, logs of inferior quality have come to be used in consequence of worsening lumber situation or for the purpose of keeping the plywood production cost from rising by reducing lumber price which accounts for the major portion of the production cost.

In the meantime, with a view to improving the yield of veneer from logs used and enhancing the operational efficiency of the shop, there has arisen intensifying demand for a veneer lathe capable of producing a veneer of good quality from a log of poor quality at a high speed and until the log is peeled to the smallest possible diameter.

Generally, the veneer lathe, in producing a veneer from a log, necessitates use of a so-called pressure member for exerting pressure to the freshly peeled veneer against the log near the edge of a knife as an indispensable element. As the pressure member, the stationary pressure nose bar and the rotary roller bar (of both driver and follower types) have been known to the art. The stationary pressure nose bar has an advantage that it can be easily installed at a prescribed position derivable from the particular cutting conditions involved. It, on the other hand, has a disadvantage that a great load resistance is generated during the peeling of veneer and, therefore, the log being cut is liable to sustain breakage because the area of pressure application by the pressure nose bar extends throughout the entire length of the log. In contrast, the rotary roller bar offers very small resistance during the peeling of veneer. Particularly the roller bar of the type adapted to operate with driven rollers is allowed to decrease the resistance to a great extent. The roller bar, nevertheless, has a disadvantage that it is difficult for the roller bar to be accurately set at the prescribed position derivable from the particular thickness of veneer being peeled off the log.

In the production of a veneer by the operation of the veneer lathe, the best results are obtained when the pressure is applied at a position separated from the edge of the knife by a distance of about 20% of the thickness of the veneer desired to be produced in the direction opposite the direction of the rotation of the log. Satisfaction of this particular condition becomes increasingly more impracticable in proportion as the diameter of the roller bar increases. As the diameter of the roller bar increases and the periphery of the roller bar is consequently brought closer to the aforementioned prescribed position for pressure application to the log, the rear face of the knife and the lower portion of the periphery of the roller bar approach each other so much that the roller bar comes into contact with the rear face of the knife before it reaches the prescribed position for pressure application, with the result that desired application of pressure at the prescribed position will become completely impracticable. Thus, the aforementioned condition becomes severe in proportion as the thickness of the veneer desired to be peeled is decreased. As one solution for the difficulty, there has been established a practice of limiting the maximum diameter of the roller bar only to about 16 mm. Since the diameter of the roller bar is so small and the revolution number is inevitably increased to extremity, the burden on the bearing of the roller bar is so enormous as to call for a special lubricating system.

Further, as disclosed in U.S. Pat. No. 4,221,247 there has been lately developed a veneer lathe comprising pressure-contacting disks provided with a large number of saw-teethed blades on their periphery against a log and rotating the log by driving the disks.

The veneer lathe adapted to be peripherally driven as described above, however, has a possibility that the peripheral driving will tend to inflict scratches and cracks upon the log, the scratches and cracks will collect wood chips thereon when they are squeezed between the log surface and the pressure bar, and the chips will occasionally find their way past the pressure bar to impart flaws to the surface of the veneer, clog the knife opening for the pressure nose bar of the veneer lathe and compel the operation of the veneer lathe to be interrupted, impair the uniform distribution of the pressure of the pressure bar, and degrade the quality of the produced veneer. This veneer lathe has another disadvantage that the pressure used in driving the saw-teethed blades of the discs into the log will warp the log even to a point where it is difficult for the peeling of the veneer to be continued until a sufficiently small diameter of the log. Further, this veneer lathe leaves numerous punctures in the peeled veneer. Particularly when the veneer is produced from a brittle log or it is produced in a small thickness of less than 1 mm, such punctures possibly give rise to tears in the veneer while the veneer is peeled off the log or it is transported. The veneer containing such tears can no longer be used as outer veneers in a plywood which determine the commercial value of the produced plywood. Even when the veneer is used in intermediate veneers, the yield is still low.

SUMMARY OF THE INVENTION

The first object of this invention is to provide a veneer lathe which is capable of producing quality veneer free from punctures in high yields from a low-quality log containing cracks or decay.

The second object of this invention is to provide a veneer lathe which avoids appreciable occurrence of chips and, therefore, precludes possible mechanical trouble due to clogging of the blade with chips.

The other objects of this invention will become apparent from the further disclosure of invention to be given herein below.

BRIEF DESCRIPTION OF THE DRAWINGS

The further objects and advantages of the present invention will become apparent from the detailed description of the invention to be given herein below with reference to the accompanying drawings, in which.

DETAILED DESCRIPTION OF THE INVENTION

Prior to the description of the embodiment of this invention, the operation of a conventional veneer lathe provided with a pressure nose bar as performed on a cracked log will be described with reference to the series of diagrams of FIG. 1 which depict the gradual growth of the crack in the log until complete fracture of the log.

(A) A log 1 containing a crack R is mounted in position on a conventional veneer lathe wherein a pressure nose bar 3 is disposed as opposed to a knife 2. When the log 1 is rotated in the direction of the arrow A by the veneer lathe to effect the peeling of a veneer, the peeling of the veneer proceeds while the edges M and N of the crack R are pushed in the direction of the crack R by the pressure of the pressure nose bar 3 and, consequently, separated from the edge of the knife 2.

(B) The edges M and N of the crack R resume their original shape and return to their original positions after they have advanced past the pressure nose bar 3 and have been released from the pressure.

(C) When this cycle is repeated, the edges M, N gradually grow in the shape of a bump.

(D) Eventually the bumps collide into the edge of the knife with force so strong as to fracture the log completely.

The inventors conceived an idea of correcting the drawback of the pressure nose bar by use of roller bars, prepared for the sake of a preliminary test a pressure member formed of a plurality of pressure nose bars and roller bars alternately disposed in a longitudinal direction, mounted this pressure member on a pressure bar frame in such a way that the pressure nose bars and the roller bars would be disposed alternately thereon, and repeated the preliminary test with the device so constructed. The results of the preliminary test revealed that the difference in the effects of the pressure nose bars and the roller bars in exerting pressure on the log is reflected in the lack of uniformity in the thickness of the veneer peeled off the log. Thus, the device proved incapable of producing a veneer fitting the manufacture of commercially acceptable plywood.

The objects of this invention have been accomplished by using circular discs in the place of roller bars in the device produced for the sake of the preliminary test as described above.

Now, the present invention will be described in detail below with reference to a preferred embodiment of this invention illustrated in the accompanying drawing.

Figure 1A:
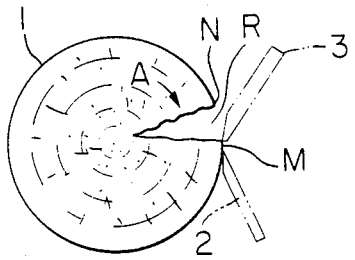
FIG. 1 is a semi-diagrammatical side elevation illustrating the condition in which a conventional veneer lathe using a pressure nose bar is utilized for peeling a veneer from a log containing a crack.
Figure 1B:
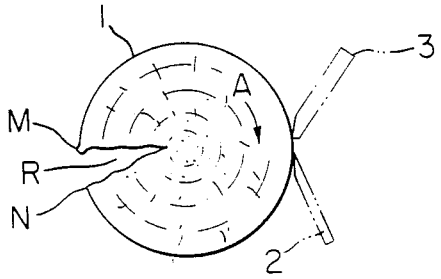
Figure 1C:
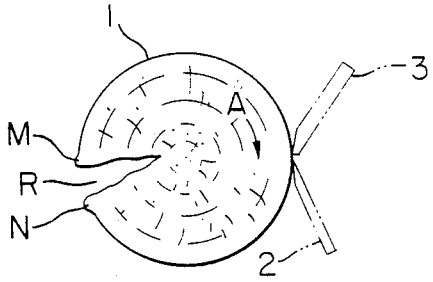
Figure 1D:
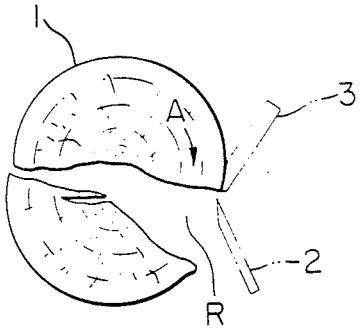
Figure 2:
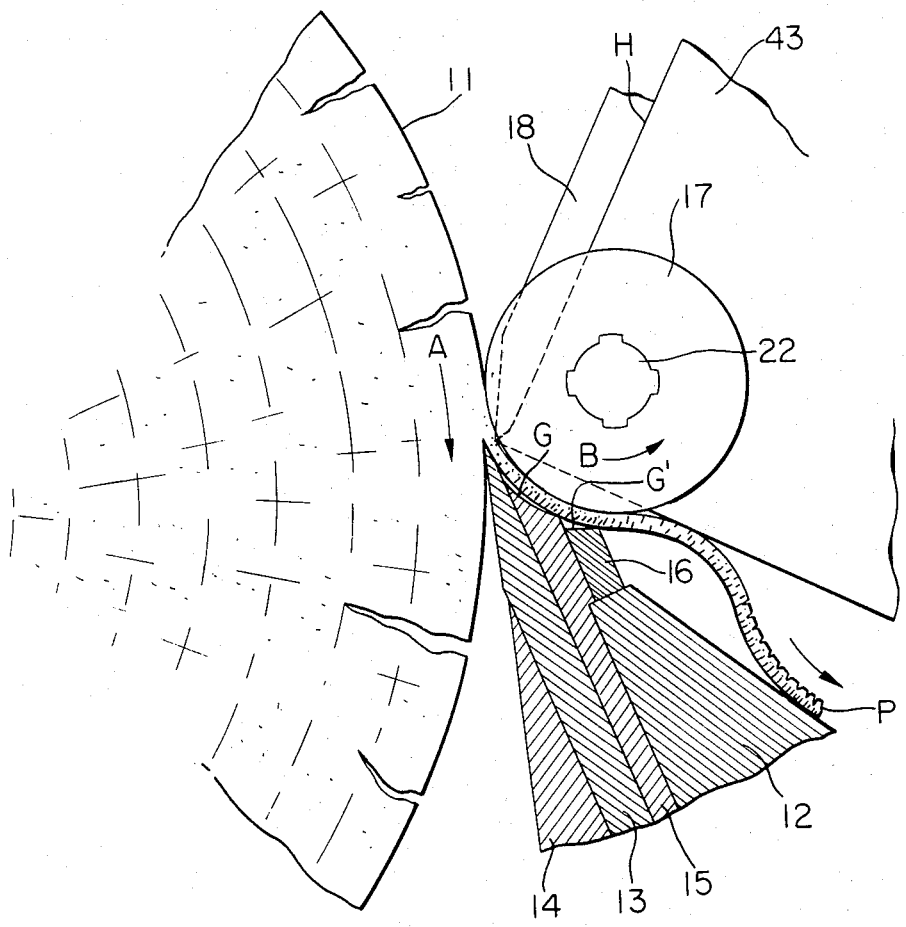
FIG. 2 is a lateral cross section illustrating an essential part of a veneer lathe embodying the present invention.
Figure 3:
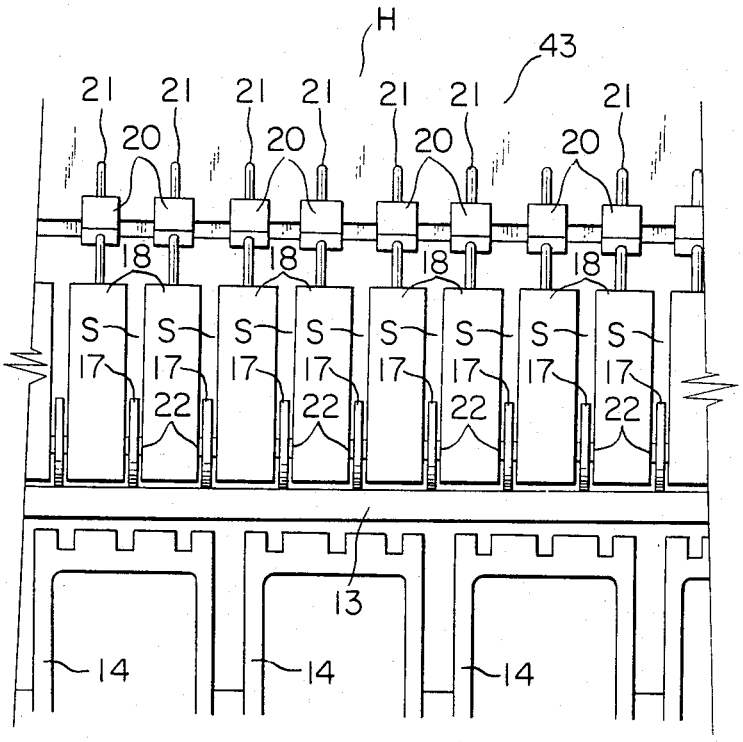
FIG. 3 is a front view of the veneer lathe of FIG. 2.
Figure 4:
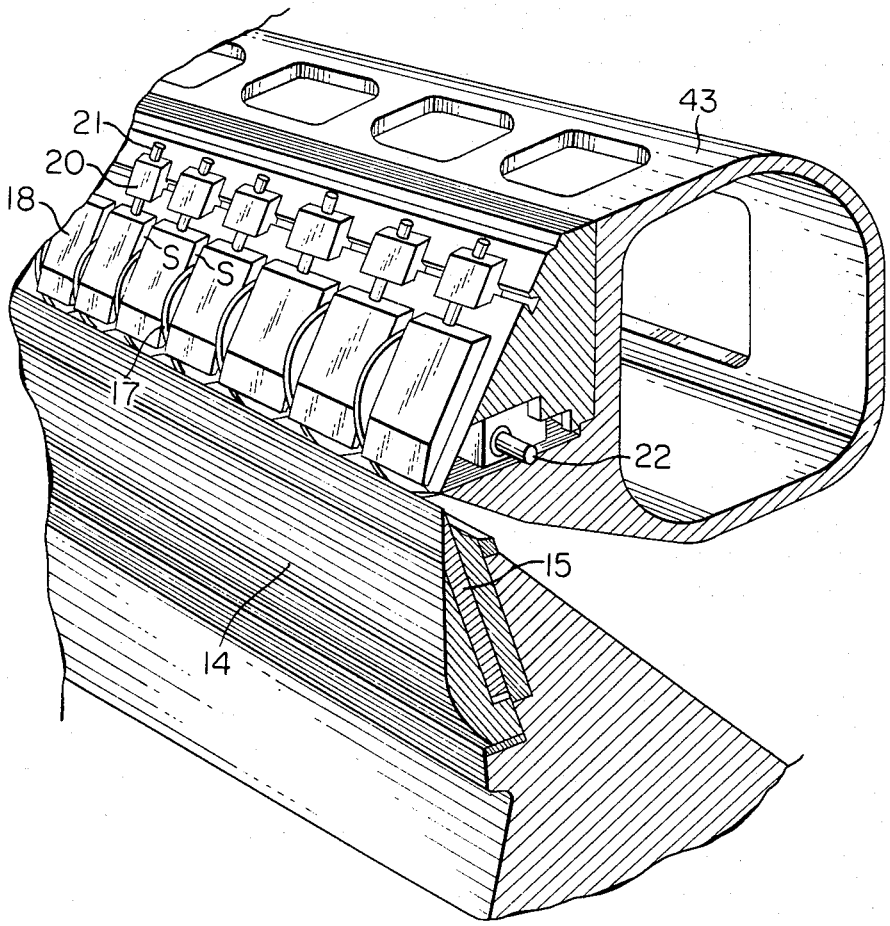
FIG. 4 is a perspective of the veneer lathe of FIG. 2.

As illustrated in FIG. 2 to FIG. 4, a log 11 is rotated about its axis in the direction of the arrow A as held in position by spindle chucks (not shown) applied fast to the opposite end faces of the log. A knife frame 12 and a pressure bar frame 43, as a vertically opposed set, are simultaneously held fast in position with their opposite end faces secured by a retaining member (not shown). By means of feed screws (not shown), they are quickly moved toward or away from the log 11. Further, the knife frame 12 and the pressure bar frame 43 are connected to an inching unit (not shown) adapted to advance them by a distance equalling the prescribed thickness of the veneer to be peeled off the log 11 for each complete rotation of the log 11. The knife frame 12 is formed in a substantially triangular cross section and a knife 13 is tightly secured with a knife holder 14 on the side of the knife frame 12 opposed to the log 11, with the edge thereof held upwardly. The knife frame 12 is provided on the side thereof adjoining the knife 13 with a guide member 15 formed of a stainless steel, for example. At the top of this guide member 15, there is formed an arcuate or slanted veneer guide face G which serves as a path for the veneer P peeled off the log 11. At the top of the knife frame 12 on the lower side of the guide member 15 relative to the direction of the advance of the peeled veneer, there is disposed a tip 16. Optionally, this tip 16 may be formed as part of the guide member 15. Since this tip 16 is susceptible of heavy wear, it is more advantageous economically and from the standpoint of maintenance to form the tip 16 as a separate piece from the guide member 15. The guide faces G, G' at the tops of the guide member 15 and the tip 16 have their beginning ends at positions slightly backward from the edge of the knife 13. These guide faces G, G' are formed as curved so as to conform to the outer face of a circular disc 17 which will be described fully afterward. Otherwise, they are formed in the shape of slanted faces gradually approaching the lines where the perpendicular lines passing the axis of the circular disc 17 and the lower portion of the periphery of the circular disc 17 intersect each other. The guide member 15 and the tip 16 are integrally formed in a length enough to extend over the entire length of the knife frame 12 (in the direction of the length of the log 11). Otherwise, they may be each divided into a plurality of segments or they may be disposed in the form of several divided pieces as suitably interrupted in the direction of the length of the knife frame. In another embodiment of this invention, rollers or other similar means may be disposed on the guide faces of the guide member 15 and the tip 16 to enhance the smoothness with which the peeled veneer is forwarded. In the production of a veneer from a log of relatively good quality, the consideration required in designing the faces at the tops of the guide member 15 and the tip 16 for ensuring the smoothness of the advance of the veneer is not necessary. In this case, the guide member 15 and tip 16 may have their top faces formed in a simple straightly inclined plane from the point in the neighborhood of the edge of the knife 13 through the point adjacent to the rear inclined face of the knife frame 12 serving as the path for the veneer. Above the knife frame 12 is supported in position the pressure bar frame 43. As described above, the pressure bar frame 43 and the knife frame 12 and held as nipped at the opposite end faces thereof by the retaining member and adapted to be moved forward or rearward relative to the log 11. The side of the pressure bar frame 43 opposed to the log 11 is defined by an inclined face H. In this inclined face H, a plurality of stationary pressure bars 18 of a small width slantingly disposed as illustrated in FIG. 3 and capable of pressing the outer surface of the log 11 are separated by small intervals. Optionally, all or a plurality of the inclined pressure bars 18 may be formed integrally in one piece, with notches cut one each at the portions corresponding to the gaps S interposed between adjacent stationary pressure bars 18 illustrated in FIG. 3. About halfway in the inclined face H of the pressure bar frame 43, height adjusting mechanisms 20 are disposed. Through these height adjusting mechanisms 20 are inserted adjusting screws 21 whose lower ends are connected to the stationary pressure bars 18. By means of these height adjusting mechanisms 20, the positions at which the lower ends of the pressure bars 18 apply pressure to the log 11 is adjusted as required. The application of pressure to the log 11 by the stationary pressure bars 18 serves the purpose of preventing the veneer from sustaining cracks upon departure from the knife, regulating accurately the thickness of the veneer peeled off the log, and effectively smoothening the peeled skin of the veneer. The veneer discharge portion defined by the leading ends of the stationary pressure bars 18 and the edge of the knife 13 is referred to as "a knife opening for the pressure nose bar."

Figure 5:
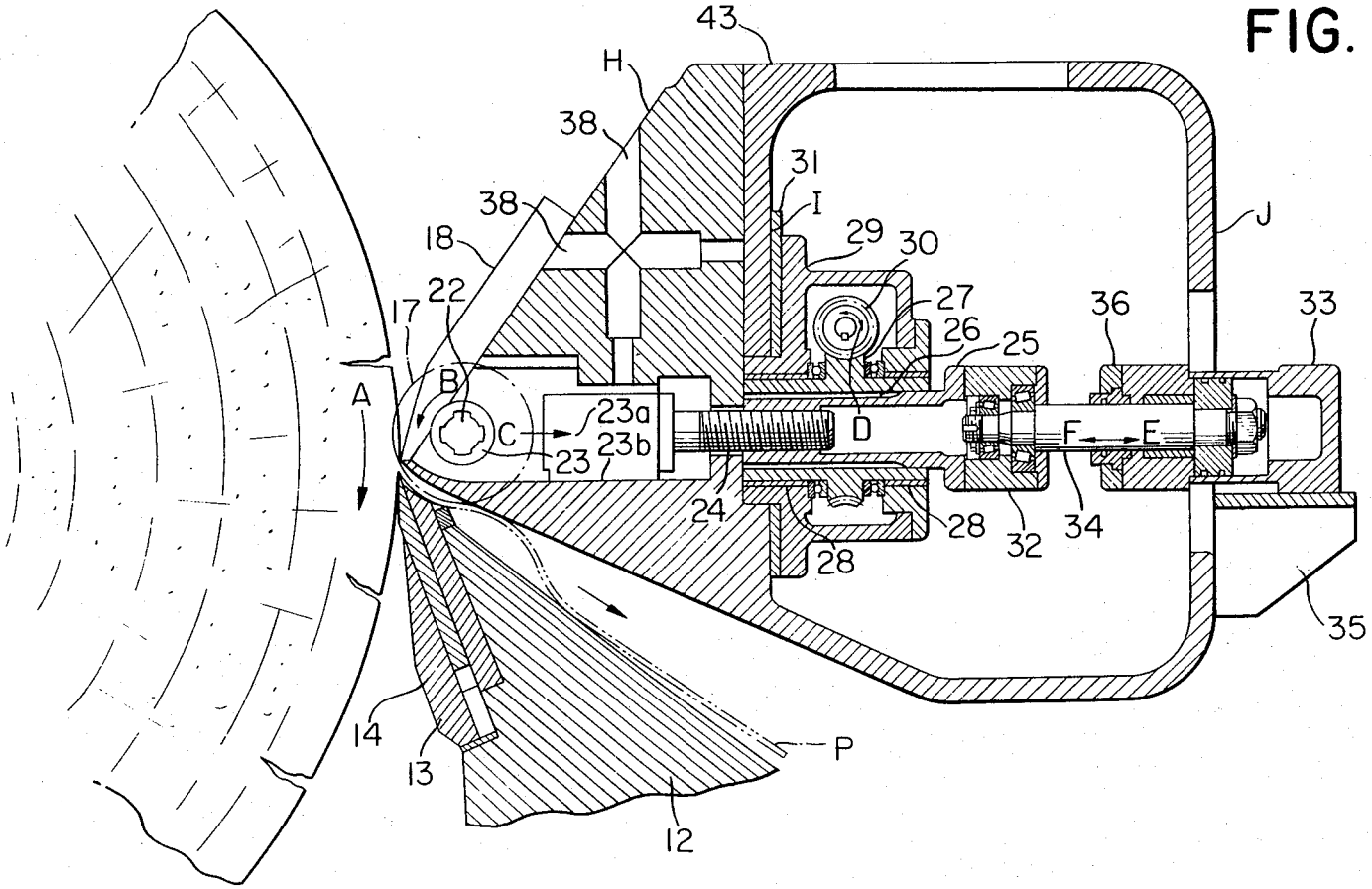
FIG. 5 is a cross section illustrating the construction of the veneer lathe of FIG. 2.

On the pressure bar frame 43, a rotary shaft 22 is pivotally supported in the neighborhood of the aforementioned knife opening for the pressure nose bar parallel to the knife 13. On this rotary shaft 22, a plurality of thin circular discs 17 having a smooth circumferential face are fitted fast as regularly spaced. The illustrated circular disc 17 has a true circle as its boundary. Optionally, the circular disc 17 may contain a plurality of radially spaced slits extending from the boundary toward the center. As illustrated in FIG. 3, the circular discs 17 are disposed in the gaps separating the stationary pressure bars 18 or, in the case of stationary pressure bars 18 formed integrally in one piece and containing therein a plurality of notches, in the notches cut in the integral pressure bar. The circular discs are evenly spaced throughout the entire length of the pressure bar frame 43 (in the direction of the length of the log 11). Optionally, some of them may be omitted in the middle portion or in the end portions of the entire length of the pressure bar frame 43. When necessary, they may be disposed so that they are densely distributed in the neighborhood of the spur knives (serving to determine the width of the veneer being peeled). The ratio of the total of the widths of the individual circular discs 17 to the total of the widths of the individual stationary pressure bars 18 is desired to fall in the range of 0.5:10.5 to 3:7, preferably in the neighborhood of 1:10. The rotary shaft 22 is generally formed in a splined section as illustrated in FIG. 2. Through the medium of an endless conveyance mechanism (not shown) such as, for example, a chain, this rotary shaft 22 is interlocked with a variablespeed motor (not shown) fixed in position above the pressure bar frame 43 and further provided with a tension mechanism so as to be rotated in the direction of the arrow B. The circular discs 17 are driven at a speed higher by 1 to 35%, preferably by 2 to 20%, than the peripheral speed of the log. The circular discs 17 gradually wear on the boundary with use even to a point where the peripheral speed thereof notably decreases for a fixed revolution number. The overall performance of the veneer lathe, however, may be retained intact despite this gradual wear of the circular discs by increasing the revolution number of the circular discs 17 for thereby keeping the peripheral speed thereof constant. FIG. 5 is a lateral cross section illustrating the neighborhood of the knife opening for pressure nose bars and the pressure bar frame. This diagram depicts in detail the pressure absorbing mechanism and the protraction-retraction mechanism for the circular disks according to this invention. Bearings 23 for supporting the rotary shaft 22 are needle bearings, for example, which are retained suitably at a plurality of points in the axial direction. The plurality of bearings 23 are integrally retained as connected by linking parts **23*a* which are disposed parallel to the aforementioned axial direction. When necessary, the lower sides of the linking parts 23*a* are held in contact with the sliding faces 23*b* containing a top coat resistant to wear and are adapted to slide on the faces in the direction of the arrow C. The linking parts 23*a* are provided at the rear sides thereof with thread shafts 24 slightly elongated rearwardly. The thread shafts 24 are disposed one each near the opposite ends of the linking parts 23*a* disposed parallel to the axial line of the rotary shaft 22. Female threads 25 to be helically fitted to the thread shafts 24 are extended rearwardly (to the right in the diagram of FIG. 5). Through the medium of keys 26 buried in the key sockets bored in the outer faces thereof, the female threads 25 are connected to a worm wheel 27 adapted to fit around the outer face of the female thread 25. The worm wheel 27 is encased in a worm box 29 and kept stationary in the axial direction by thrust bearings (not shown) and in the radial direction by bushes 28. A worm 30 which is meshed with the aforementioned worm wheel 27 to form speed-reducing mechanism is stowed in position in conjunction with the worm wheel 27 within the worm box 29. The worm box 29 is attached fast, if necessary through the medium of a plate 31, to the inner fitting face I embraced within the pressure bar frame 43 of a tubular construction. It functions to maintain accurately the axial line of the pressure absorbing mechanism extending perpendicular to the axis of the rotary shaft 22. One axial end (not shown) of the worm 30 is extended outwardly. To the extended axial end is pivotally fitted a chain wheel, for example. This chain wheel is interlocked through a chain to a motor such as a pulse motor. By the prescribed amount of the normal or reverse rotation of this motor (in the direction of the arrow D shown in the diagram), the thread shaft 24 is moved by the prescribed amount in the direction of the arrow C via the worm wheel 27, the key 26, and the female thread 25. The direction, amount, etc. of the rotation of the worm 30 are controlled by an electric control device and a known log-diameter detection mechanism which comprises movement limiting elements such as limit switches or microswitches set in advance to issue stated signals and adapted to be actuated by the outer periphery of a rotary coupling 32 which will be described afterward, log-diameter detecting limit switches arrayed in the direction of the movement of the knife frame, for example, and limit dogs attached fast to the moving part of the knife frame. Owing to the use of the control means as described above, the action of imparting a fixed amount of rotation to the aforementioned worm 30 each time a stated log-diameter is reached and thereby causing the circular disc 17, through the medium of the thread shaft 24, to be moved toward and pressed against the log or moved away the log can be automatically effected. When desired, the operator tending the veneer lathe is free to operate manually this mechanism while keeping an eye on the condition of log peeling. Optionally, the work gear mechanism which comprises a speed-reducing mechanism capable of accurately sensing and controling a minute amount of movement of the circular disc, the aforementioned worm, and the worm wheel may be substituted by some other tooth-wheeled speed-reducing mechanism or it may be disposed outside the pressure bar frame. The terminal of the female thread 25 is linked to the leading end of a piston rod 34 protruding from a fluid cylinder 33 via a rotary coupling 32 embracing therein a spherical roller bearing, for example. When the female thread 25 is rotated by the rotary movement of the aforementioned worm 30, therefore, the outer periphery of the rotary coupling 32 which is connected to the aforementioned female thread is simultaneously rotated with the female thread. This rotation, however, is not transmitted to the piston rod 34 which is connected to the inner race through the bearing. In the embodiment described so far, two mechanisms for moving the circular discs forward and rearward are disposed one each at the opposite ends. Optionally, just one such a mechanism may be provided at the center. The linking parts 23***a* may be omitted. Otherwise, the linking parts 23*a* disposed at the opposite ends may be severed from each other and disposed near the opposite bearings 21 either independently or in such a manner as to be interlocked to each other.

The fluid cylinder 33 is mounted on a bracket 35 and secured accurately to the rear fitting face J of the pressure bar frame 43 prepared in a plane exactly perpendicular to the axial line of the aforementioned thread shaft 24. The action of pressing the circular disc 17 against the log 11 and the action of preventing the circular disc 17 from the shocks exerted by the log 11 are effected by means of the female thread 25 and the rotary coupling 32 which are helically fitted to the aforementioned thread shaft 24, the fluid cylinder 33 disposed as connected to the aforementioned rotary coupling 32, and a pressure adjusting switch mechanism which is omitted from the diagram and is described fully afterward. FIG. 5 illustrates the condition in which the piston rod 34 of the fluid cylinder 33 is moved forward to the limit of its advance (to the left, namely in the direction of the arrow F in the diagram). The rearward movement of the piston rod 34 to the right, namely in the direction of the arrow E, from the illustrated position is effected when the compressed fluid flows in through a cylinder head 36 on the lefthand side in the diagram. Consequently, the rotary coupling 32 and the female thread 25 are simultaneously moved to the right relative to the diagram. In this case, the outer periphery of the female thread 25 which remains in contact with the inner face of the worm wheel 27 is moved in the direction of separating from the worm wheel 27 as slid on the opposed faces of the two parts mentioned. The length to which the female thread is fitted in the aforementioned worm wheel 27 is quite ample relative to the amount of movement the piston rod 34, so that the greater part of the female threads is always inserted in the worm wheel. The keys between them are desired to be in the form of double keys or splined grooves to permit both rotary and sliding movements. As the fluid cylinder 33, there is generally adopted a hydraulic cylinder. The aforementioned compressed fluid is obtained by a unit which comprises an electric control circuit possessed of two pressure paths at least capable of adjusting pressure and incorporating in the paths a plurality of relief valves or reducing valves and solenoid switch valves. The fluid cylinder 33 is adapted so that, by means of push-button switches, a plurality of magnitudes of pressure set in advance at graded levels may be freely applied to the cylinder so as to increase the pressure in proportion as the hardness of the log increases in the course of the veneer peeling.

The fluid cylinder displays a moderate shock-absorbing ability to the roller disc owing to the pressure transmitting action of a liquid where the fluid is a liquid, the elastic deformation of an elastically deformable member such as a rubber hose where a rubber hose is incorporated in the path of pressure transmission, or the compressing action of a gas where the fluid is a gas.

Even when the circular disc collides into a node or crack in the log, the resultant impacts will never be suffered to inflict breakage to the log. For a rapid rearward movement of the circular disc, the fluid cylinder is advantageously utilized. When the log to be peeled has good quality, the veneer lathe of this invention can peel a veneer from this log even with the circular disc held in its retracted position.

The fluid cylinder and other members of the pressure absorbing mechanism described above may be arranged similar to the components of the protraction-retraction mechanism, i.e. the circular disc 17, worm 30, worm wheel 27, the female thread 25, and the thread shaft 24. Otherwise, they may be disposed concentrically at the center of the circular disc or separately at the opposite end portions without reference to the aforementioned protraction-retraction mechanism. In FIG. 5, the front part H of the bolt inserted through a fitting bolt socket 38 bored in the pressure bar frame has a substantially triangular lateral section (not shown) so as to cover the aforementioned bearing 23, the connecting part 23*a*, etc. on the log peeling side.

With respect to the foregoing arrangement embodying this invention, the operation and effect of this invention will be described below. The plurality of circular discs 17 which have a smooth peripheral face are driven at a peripheral speed greater than the peripheral speed of the log 11. At the same time, they are kept in contact with the log 11 at all times with suitable pressure by means of the fluid cylinder 33. Consequently, the pressure exerted by the circular discs 17 is substantially in a horizontal direction or against the log laid in a horizontal direction and the rotational driving force exerted by the aforementioned circular discs is in the direction tangential to the log at a peripheral speed greater than the peripheral speed of the log cooperate. The resultant combined force manifests itself as a force tending to press the log 11 toward the downwardly oblique direction. Thus, the circular discs manifest an outstanding effect in preventing the log from being warped in a direction opposite the direction in which the veneer is peeled off the log by the knife as otherwise involved in the production of a veneer by the conventional veneer lathe and precluding the phenomenon called "bending," i.e. the phenomenon that the central portion in the axial direction of the log held in position by spindles attached fast to the opposite end faces thereof and rotated thereby about the axis thereof tends to bend away the knife 2. Further the production of a veneer by the veneer lathe is liable to entail a phenomenon that the knife tends to cut its way gradually deeply into the log and the log is consequently swerved toward the pressure bars so as to increase the frictional resistance of the stationary pressure bars. In the present invention, the aforementioned possible increase of the resistance of the stationary pressure bars is precluded by the fact that the plurality of circular discs 17 are pressed against the periphery of the log and rotated thereon at the position slightly upward in the rotational direction of the log from the position at which the stationary pressure bars 18 apply pressure to the log.

When the log to be peeled happens to contain a crack, since the circular discs 17 continue to exert a shock-absorbing action with a proper pressure on the outer periphery of the log at a point slightly upward in the direction of the rotation of the log from the point at which the stationary pressure bars 18 press the outer periphery of the log and, at the same time, impart a rotational movement to the log at a peripheral speed greater than the peripheral speed of the log 11, these circular discs function to push the starting edges of the crack N, M with ample impetus into the knife opening for pressure nose bars and compel the knife to effect the required peeling of a veneer from the log. The fracture of a log such as is illustrated in FIG. 1 (D) can never happen in the production of a veneer by the veneer lathe of the present invention. In the production of a wide, thin veneer by the veneer lathe of this invention, if a portion of the log decayed by weathering is broken into fragments, such fragments are not suffered to clog the knife opening for pressure nose bars or the fragments are not transported on the freshly peeled veneer and, as extraneous particles, suffered to cause trouble of some sort or other in the subsequent steps.

These advantageous effects are conspicuously manifested particularly when the circular discs are disposed slightly upwardly in the direction of the rotation of the log from the point at which the stationary pressure bars 18 exert pressure on the log.

We claim:

1. A motor driven veneer lathe for peeling a veneer from a log, comprising:

(a) knife means having a cutting edge for peeling said veneer from said log;

(b) a plurality of pressure bars mounted on a pressure bar frame and spaced thereon at constant intervals, wherein each of said pressure bars exerts pressure on said log through a leading edge parallel to the cutting edge of said knife means;

(c) a plurality of circular discs, each having a smooth circumference, and each interposed between two of said pressure bars, retained in position by said pressure bar frame through the medium of a drive shaft;

(d) means for moving said pressure bar frame toward the center of said log while said veneer is peeled; and (e) means for exerting a substantially constant pressure on said log through said circular discs, wherein said exerting means is independent of said moving means.

2. The motor driven veneer lathe of claim 1, further comprising adjusting means for positioning said circular discs, independent of said pressure means and said moving means.

3. The motor driven veneer lathe of claim 1, wherein the point at which each of said circular discs comes into contact with said log is slightly upward in the direction of the rotation of said log from the point at which said pressure bars come into contact with said log.

4. The motor driven veneer lathe of claim 1, wherein said circular discs are driven at a peripheral speed 2 to 20% higher than the peripheral speed of the log being peeled.

5. A motor driven veneer lathe of claim 1, wherein the ratio of the total of the widths in contact with said log of all of said circular discs to the total of the widths of said leading edges in contact with said log of all of said pressure bars ranges from 0.5:10.5 to 3:7.

* * * * *